US005111928A

United States Patent [19]

Kovens

[11] Patent Number: 5,111,928

[45] Date of Patent: May 12, 1992

[54] UNIVERSAL COIN RECEIVING MECHANISM

[75] Inventor: Murray R. Kovens, Whitehall, Md.

[73] Assignee: Parkway Machine Corporation, Timonium, Md.

[21] Appl. No.: 578,217

[22] Filed: Sep. 6, 1990

[51] Int. Cl.[5] ..... G07F 5/02; G07F 11/44

[52] U.S. Cl. ..... 194/292; 194/337

[58] Field of Search ..... 194/236, 237, 255, 258, 194/292, 333, 337

[56] References Cited

U.S. PATENT DOCUMENTS

| | | | |
|---|---|---|---|
| 1,193,967 | 8/1916 | Antoine et al. | 194/292 |
| 3,185,282 | 5/1965 | Kovar | 194/236 |
| 3,189,152 | 7/1963 | Weitzman | 194/333 |
| 3,430,746 | 3/1969 | Bolen | 194/255 |
| 3,592,306 | 7/1971 | Dunn | 194/255 |
| 3,604,547 | 9/1971 | Bolen | 194/292 |
| 3,822,004 | 7/1974 | Bolen | 194/295 |
| 3,937,314 | 2/1976 | Rosenberg et al. | 194/255 |
| 4,401,202 | 8/1983 | Gitlin et al. | 194/337 X |
| 4,550,819 | 11/1985 | Smith . | |

FOREIGN PATENT DOCUMENTS

| | | | |
|---|---|---|---|
| 0194588 | 6/1938 | Switzerland | 194/255 |

*Primary Examiner*—F. J. Bartuska
*Attorney, Agent, or Firm*—Leydig, Voit & Mayer

[57] ABSTRACT

A universal, convertible coin receiving mechanism for a coin-operated bulk vending machine has an insert removably attached to the coin wheel. The insert alters the coin compatibility of the coin receiving mechanism by permitting dimensional modification of the coin channel.

19 Claims, 3 Drawing Sheets

UNIVERSAL COIN RECEIVING MECHANISM

TECHNICAL FIELD

The present invention is directed to coin-actuated machines. More particularly, the invention is directed to coin-actuated bulk vending machines and coin receiving mechanisms in such machines, which mechanisms are adapted to receive a coin to allow operation of the machine. The invention enables acceptance of coins of different denominations. In this context, the invention further contemplates coin receiving mechanisms of the type including one or more coin discrimination features.

BACKGROUND OF THE INVENTION

Flexibility is a principal objective in the design of machines and mechanisms. One key advantage is the reduction of costs associated with both the design and manufacture of a mechanism. One technique for achieving a flexible design comprises the standardization of both component parts and whole assemblies in a device. Standardization allows a single device, or slight variations thereof, to be used in a variety of applications thus avoiding expenses in the design and manufacture of a separate mechanism. Standardization also promotes labor savings and reduces the cost of replacement parts while increasing their interchangeability and availability.

In coin receipt mechanisms incorporated in bulk vending machines, for example, a universal design is desirable which can be repeatedly adjusted to accept a selected coin from various possible denominations. The monetary value of each of various coin denominations in a given currency is indicated by the physical size and shape of the coin. In the currency of the United States, for instance, the assorted coin denominations include the penny, nickel, dime, quarter, the fifty cents piece and the dollar. All of these coins are annular in configuration. However, each of these denominations comprises a unique diameter and thickness. Canada employs substantially corresponding denominations but its coins are of different sizes compared to each other and to the currency of the United States. Thus, a coin mechanism design capable of universal adaptation, as for example, to both sets of currencies, is desirable.

Inserting the appropriate coin denomination in the coin mechanism of a bulk vending machine allows a buyer to rotate a crank handle to operate the machine and dispense a product. The product may be a measured amount of a commodity, for instance, candy or discrete containers, e.g. capsules.

As a general rule, vending machine coin receipt mechanisms include one or more discrimination or rejection features. The purpose of these features is to distinguish between coin denominations and allow the mechanism to reject incorrect denominations. This prevents a machine from being cheated by operating upon receipt of a coin of an incorrect denomination of lesser value, or upon receipt of a "slug" (a counterfeit coin comprising a piece of ordinary metal, for example, machined or molded with dimensions near those of a legitimate coin).

The discrimination function may be effected by means of a variety of mechanical devices in a coin receiving mechanism designed to exploit the correspondence between a coin denomination and its physical attributes, e.g. size, shape or thickness. As an example, a slot in a coin receiving mechanism tightly dimensioned, in width or thickness, for accepting dimes would preclude insertion of a penny or nickel. This is because the dime has a smaller diameter and thickness when compared to other coins.

Thus, in a coin-operated machine using a coin-mechanism with discrimination features, the ability to "accept" a particular coin size is determined by the ability of the coin to pass through the discrimination devices. Consequently, coin receiving mechanisms equipped with rejection features inherently tend to preclude universal designs accepting different denominations.

A universal design would afford the advantages of flexibility outlined above. Additionally, there are several more specific reasons, from the perspectives of a vending machine manufacturer and users, that make a universal coin receiving design desirable.

As noted, a universal design would enable a single coin mechanism model to be used in different applications. A single vending machine could use the same model coin mechanism with simple modification to sell separate products at different prices if the coin mechanism was adapted to receive only the corresponding distinct denomination.

Also, when the price of a particular commodity changes, the coin receipt mechanism in a given vending machine could be reconfigured to require coin denominations corresponding to the new price without the need to replace the entire coin mechanism or substantial components thereof. Finally, in employing a given model of coin mechanism in most countries, a universal design would allow adapting the mechanism to the local currency comprising a whole new set of denominations.

SUMMARY OF THE INVENTION

Thus, it is an object of the present invention to overcome the problems in the prior art and provide the advantages of a universal coin mechanism specified above.

Another object of this invention is to provide, in a coin-actuated machine, a universal coin receiving mechanism configured to accept a predetermined one of any of several distinct coin denominations of a variety of different currencies.

Still another object of this invention is to provide a universal coin receiving mechanism which may accommodate a range of coin sizes.

Yet another object of this invention is to provide a universal coin receiving mechanism which may be conveniently, efficiently, and inexpensively reconfigured to accommodate a new denomination.

A further object of this invention is to provide a universal coin receiving mechanism which is capable of both discriminating a coin from one predetermined denomination and of being modified to discriminate from a different denomination.

It is another object of this invention to provide a universal coin receiving mechanism adapted to accept any predetermined one of several coin denominations, and which controls passage of a coin through the mechanism by adjustably defining therein a coin channel corresponding to the predetermined denomination.

These and other objects are satisfied by a universal coin receiving mechanism according to the present invention comprising:

means for operating the machine, said means including a coin carrier connected to the machine; and convertible discriminating means, connected to said coin carrier, for discriminating a coin from a first predetermined denomination of a first diameter and first thickness and for converting to discriminate from a second predetermined denomination of a second diameter and second thickness, said convertible discriminating means including a calibrated coin receiving insert for accepting a coin of one of said predetermined denominations.

Further objects of the present invention are satisfied by a coin operated bulk vending machine including a universal coin receiving mechanism comprising:

a) a base;

b) a merchandise container, set on and above said base;

c) a merchandise wheel disposed between said base and said container for selecting a discrete quantity of merchandise to be dispensed upon operation of said machine;

d) a merchandise dispensing passage for communicating said discrete quantity of merchandise to an opening disposed in said base; and e) a coin receiving mechanism disposed on said base and operably connected to said merchandise wheel to rotate said wheel to dispense merchandise into said passage, said coin operating mechanism including a coin carrier, convertible discriminating means, connected to said coin carrier, for discriminating a coin from a first predetermined denomination of a first diameter and first thickness and for converting to discriminate from a second predetermined denomination of a second diameter and second thickness, said convertible discriminating means including a calibrated coin receiving insert for accepting a coin of one of said predetermined denominations.

Given the following enabling description of the drawings, the inventive coin receiving mechanism, bulk vending machines incorporating the coin receiving mechanism, and the scope of the invention should become evident to a person of ordinary skill in the art.

DETAILED DESCRIPTION OF THE PREFERRED EMBODIMENT

Figure 1:
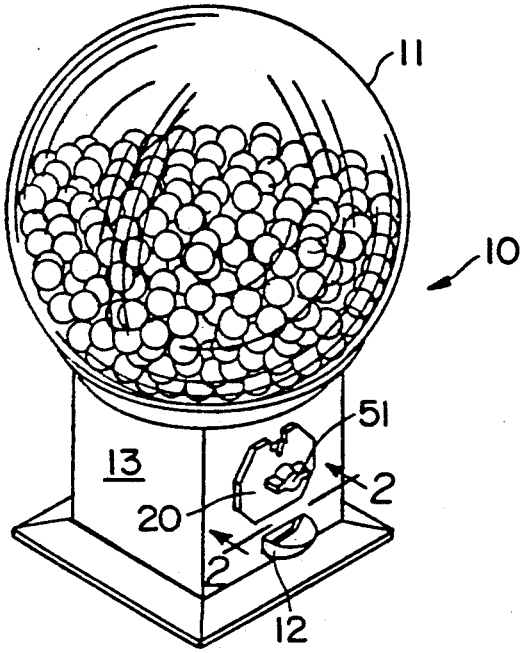
FIG. 1 is a perspective view of a typical bulk vending machine utilizing a universal coin receiving mechanism according to the invention.

FIG. 1 illustrates a coin-actuated machine according to the present invention comprising a bulk vending machine 10. The vending machine 10 includes a container 11 storing merchandise and mounted on a base 13. According to the invention, the vending machine 10 further comprises a novel universal coin receiving mechanism 20. Merchandise is discharged through a merchandise wheel and into a chute 12 when a valid coin is inserted into the coin receiving mechanism 20 allowing a crank handle 51 to turn.

Figure 5:
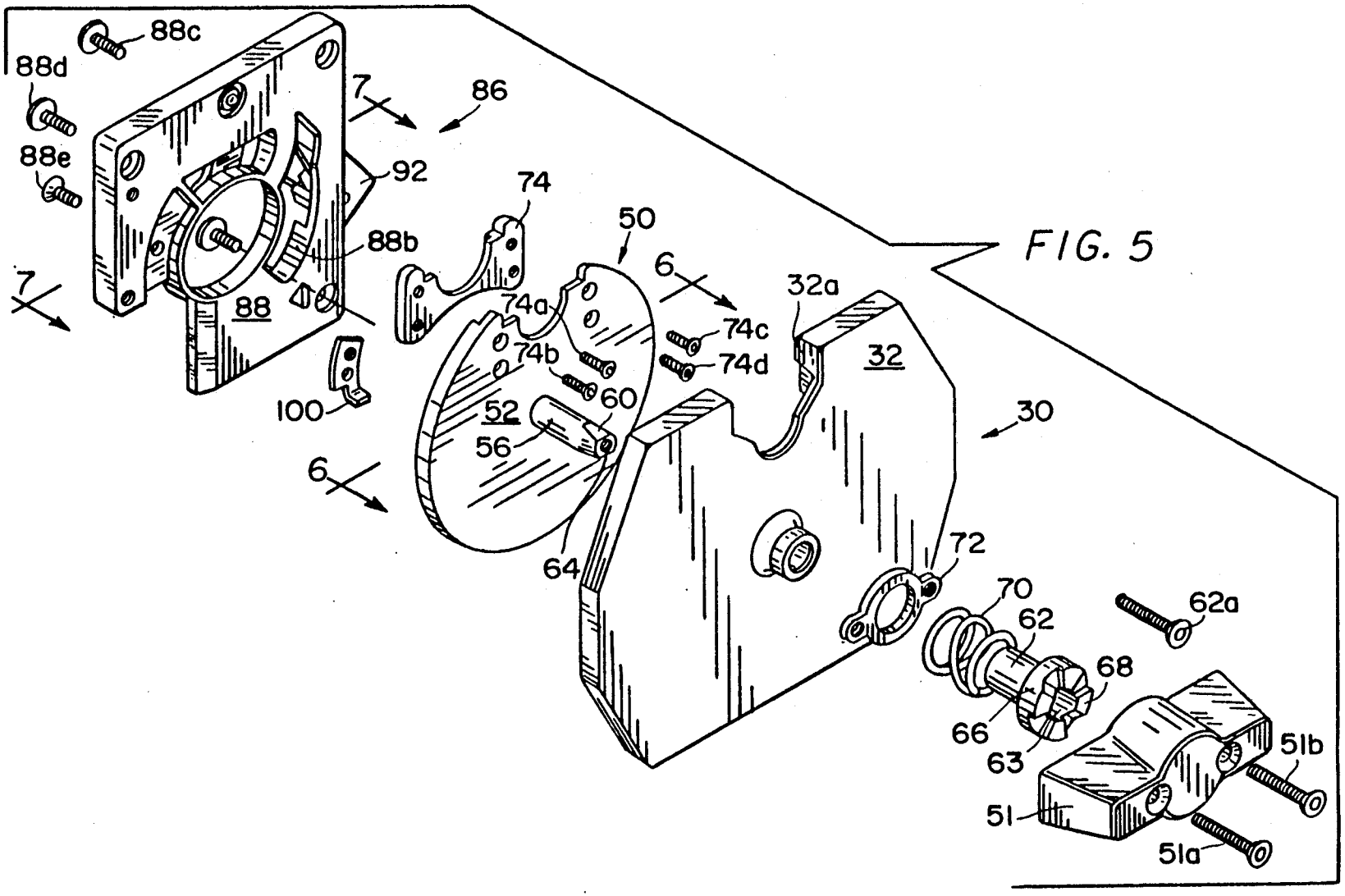
FIG. 5 is an exploded perspective view, as seen from the front, of the front plate assembly, the coin carrier member, and the back plate assembly.
Figure 6:
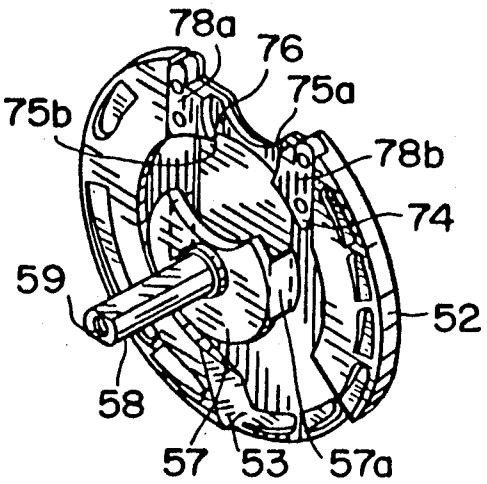
FIG. 6 is a rear perspective view of the coin carrier member.
Figure 7:
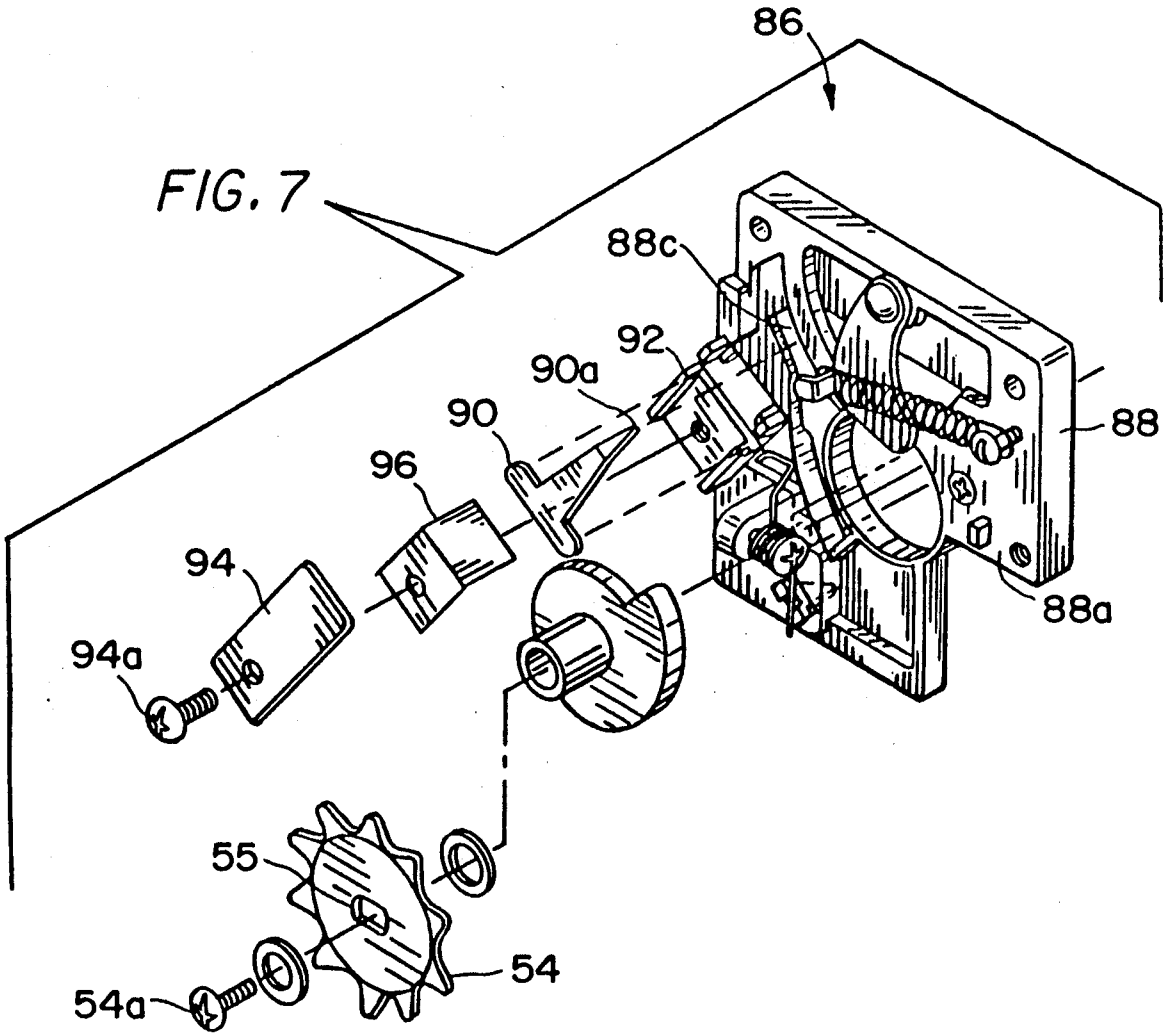
FIG. 7 is an exploded perspective view, as seen from the rear, of the back plate assembly.

FIGS. 5-7 illustrate exploded views of the coin mechanism 20 in greater detail. The coin receiving mechanism 20 depicted comprises three major assemblies including a front plate assembly 30, a coin carrier member 50, and a back plate assembly 86.

One primary purpose of the coin carrier member 50 is to connect the handle 51 to a conventional vending machine merchandise wheel (not shown) to rotate the latter and dispense merchandise. Primary to this connection is a coin carrier wheel described below.

A sprocket 54, engaged with the merchandise wheel, is rotatably connected and responsive to the crank handle 51. Hence, in the illustrated embodiment, a coin carrier wheel 52 directly couples the handle 51 and sprocket 54 to revolve synchronously, thus rotatably fixing the handle 51 and sprocket 54 together. The sprocket is disclosed only by way of example. It may be replaced by a variety of actuators, including other types of gears or other assembly engaged with the merchandise wheel for operating the latter.

The handle 51, coin wheel 52 and sprocket 54 may be directly coupled in a variety of ways. In the embodiment depicted, the handle 51 and coin wheel 52 are rotatably connected by an input shaft 56. The coin wheel 52 and sprocket 54 are coupled through an output shaft 58. Both the input and output shafts 56, 58 are fixed to the coin wheel 52. As illustrated particularly in FIGS. 5 and 6, these shafts 56, 58 are further molded or machined from a single piece with the coin wheel 52.

The handle 51 is mounted onto the input shaft 56 to rotate therewith as follows. The input shaft 56 is formed with a chamfer 60 in an otherwise cylindrical exterior surface. This chamfer 60, acting as a key, engages a reciprocally contoured surface of an internal bore 63 defined in a hollow rotary coupling 62. This prevents relative rotation between the coupling 62 and shaft 56 when assembled. These parts are positionally maintained by a screw **62*a*, for example, passing through the internal bore 63 of the coupling 62 and into a threaded bore 64 in the shaft 56**.

The rotary coupling 62 further includes a hub 66 machined or formed to act as a key between itself and the handle 51. Consequently, the hub 66 has beveled teeth 68 on the outer surface thereof. The handle 51 is hollow defining an interior cylinder (not shown) adapted to receive the hub 66. Further, the blind end of this internal cylinder is reciprocally formed with camming notches which engage the teeth 68 of the hub 66 preventing relative rotation between the rotary coupling 62 and handle 51 until sufficient rotary force is applied to overcome the spring bias and frictional forces maintaining engagement of the teeth to the notches. This is conveniently referred to as a "slip-clutch" handle. The coupling 62 and handle 51 are urged together by a spring 70. Thus, an arrangement is provided including a flanged grommet 72 secured to the handle 51 by screws **51*a*, 51*b* and sandwiching the spring 70 and coupling 62** therebetween.

Similarly, the output shaft 58 has a cross section having an oblong profile. The sprocket 54 is mounted onto the output shaft 58 and secured by a screw **54*a* received in a threaded bore 59 in the shaft 58. The external surface of the shaft 58 thus keys with a reciprocally contoured center hole 55 of the sprocket 54 such that the shaft 58 and sprocket 54** rotate together.

The coin carrier member is adapted to receive and pass an authorized coin through a channel in the coin receiving mechanism. On the other hand, the front plate assembly, the coin carrier member and the back plate assembly cooperate to define a coin carrying assembly and include discrimination devices for selectively preventing passage of unauthorized coins. These elements also include additional devices for otherwise controlling coin passage through the mechanism. In this context, the coin carrier member 50 of the present invention further includes a novel replaceable coin insert illustrated at 74 in FIGS. 5-7.

The insert is calibrated such that only an authorized, valid coin of a predetermined denomination is received in and successfully passed through the coin mechanism 20. Because several lines or collections of replaceable inserts may be manufactured, inventoried, and installed inexpensively, a multiplicity of different currencies may be accommodated by the same coin mechanism 20. Accordingly, the inventive coin receipt mechanism is conveniently converted to accommodate a new denomination or currency by replacing the insert 74 as follows.

In general terms, when the coin receiving mechanism 20 is assembled, the insert 74 is sandwiched between the coin wheel 52 and a back plate 88 of the back plate assembly 86. The back plate 88 is secured by screws 88*c*-88*e* to a front plate 32 of the front plate assembly 30 capturing the coin wheel 52 therebetween.

The insert is formed from synthetic resins or metal, for example, by machining or molding. The insert 74 comprises a configuration generally defining a pocket between the coin wheel 52 and the back plate 88. This pocket comprises part of a coin channel adjustably defined by replacement of the removable insert.

In the embodiment of FIGS. 5-7 particularly, the coin insert 74 is mounted on the coin carrier wheel 52 by screws 74*a*-74*d*. The front plate includes a slot cut 32*a* as depicted particularly in FIG. 5. This slot 32*a* exposes the pocket defined by the insert 74 to facilitate insertion and removal of a coin. However, the width of the slot 32*a* is narrow enough to hide the insert screws 74*a*-74*d* behind the front plate 32.

A slight clockwise rotation of the handle 51 turns the coin wheel 52 enough to expose the two insert screws 74*a* and 74*b* on the left. To replace the insert 74, these are removed first. A valid coin is then placed in the insert 74 to trip the discrimination devices allowing the handle 51 to rotate. The handle is turned almost, but not quite a full revolution to reveal, through the slot 32*a*, the two right insert screws 74*c* and 74*d*. When these are removed the coin receiving mechanism 20 is converted by removing the old insert 74 and mounting a new insert calibrated to a new denomination.

The novel universal coin mechanism of the present invention affords several significant advantages to the user. In typical prior art coin mechanisms, the entire coin wheel is replaced. In addition to the complexity involved in the required disassembly of the entire mechanism, an inventory of relatively expensive coin wheels must be purchased and stored.

With the present invention, the labor involved in converting the mechanism is minor requiring a minimum of time and a minimum degree of mechanical sophistication on the part of the user. Also, only one relatively inexpensive tool is required (typically a screw driver or allen wrench). Additionally, the costs associated with accumulating and storing the inventory of replaceable parts, and particularly, entire coin mechanisms and/or coin wheels, are essentially eliminated.

Regarding the form of the insert in the illustrated embodiment more particularly, the coin receiving insert 74 comprises a receded surface 76 defined by lateral walls of embossments or banks 78*a*, 78*b*. When pressed against the back plate 88, the sunken surface 76, banks 78*a* and 78*b*, and plate 88 define a pocket into which a coin of selected denomination is received.

The banks 78*a*, 78*b* are separated at a radially outward portion of the insert 74, where a radial direction is defined relative to the coin wheel 52. This defines a mouth or entrance strait 75*a* to a drop-through coin channel. The drop-through channel comprises one of two coin channels defined through the coin receipt mechanism 20. The strait 75*a* permits insertion therein of a coin having a diameter equal to or less than the width of the strait 75*a*. Larger coins are precluded from entering and are thus discriminated.

The banks 78*a*, 78*b* are also separated at an opposite radially inward portion defining an exit strait 75*b* in the insert 74. The exit strait 75*b* is generally more narrow than the entrance strait 75*a* to cradle valid coins within the insert 74. However, the exit strait 75*b* provides a drop-through discrimination attribute.

Invalid coins and counterfeit slugs having diameters less than the width of the exit strait 75*b* fall directly through the insert 74 into the drop-through coin channel defined through the coin mechanism 20. Thus, the insert 74, being mounted on the coin wheel 52, defines the primary discrimination means of the coin carrying assembly connected with the coin carrier member.

In the illustrated embodiment, a middle segment of this drop-through coin channel is defined through a hollowed hub 57. The hub 57 comprises opposite walls 57*a*, 57*b* disposed laterally of this channel. Coins are guided therethrough to a final discharge strait 53 defined in the coin wheel 52 emptying into a coin box in the vending machine base 13.

Calibration of each replaceable insert 74 may be achieved by adjusting different dimensions of the insert. The respective widths of the straits 75*a*, 75*b* are adjusted, for example, to the unique diameter of a valid predetermined coin denomination. Further, the thickness of the surface 76 can be adjusted. This provides a coin pocket with a predetermined thickness precluding insertion of a coin with a greater thickness.

Figure 2:
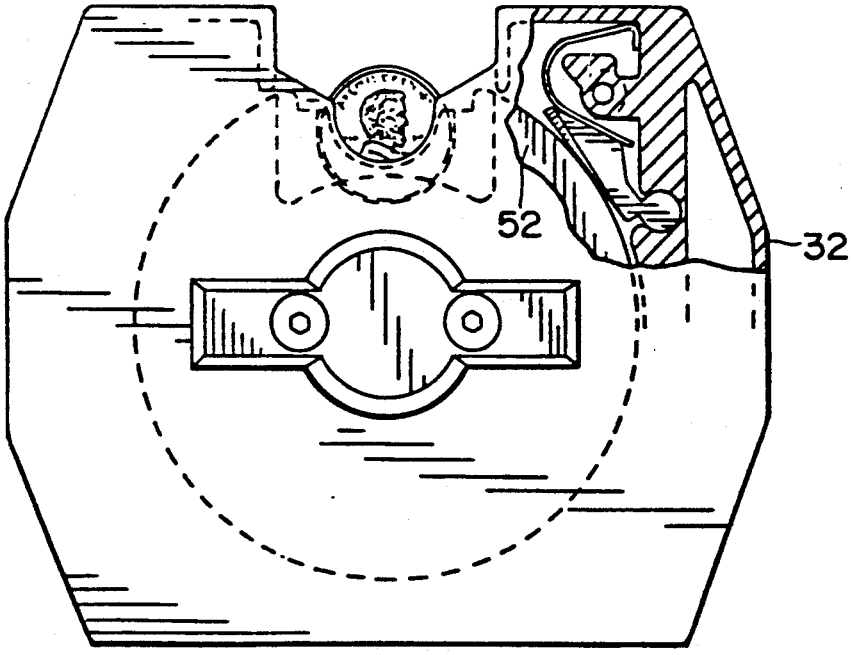
FIG. 2 is a front view of the front plate assembly of a coin receiving mechanism according to the invention, partially broken away and exposing the coin carrier wheel and the upper coin dog.

The universal coin receipt mechanism according to this invention further utilizes one of several replaceable inserts to adjustably define a second or main coin channel through the mechanism. As revealed by cut-away FIGS. 2-4, a portion of this channel is defined, in part, by the insert 74, rotating with the coin wheel 52, and a race 39. This race 39 is defined by a rim formed in the front plate 32. This main coin channel is further defined by an upper coin dog or pawl 34 pivoted within the front plate 32 proximate the circumference of the coin wheel 52 in assembly.

The coin dog 34 is located in the coin path such that the range of pivotal motion is limited. On one end of this range, the coin dog 34 is biased against the coin wheel 52 by a spring 36. As the coin wheel 52 is rotated by turning the handle 51, a tip 34*a* of the coin dog 34 is correctly deflected only when a coin of the proper denomination (diameter) is loaded in the insert 74. Thus, this convertible channel discriminates from invalid coins.

Figure 3:
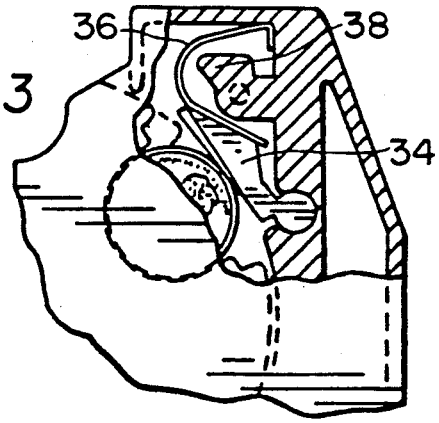
FIG. 3 is another front view of the front plate assembly, partially broken away, and illustrating a loaded coin deflecting the upper coin dog.

Correct deflection is determined by the correlation between the insert 74 and the diameter of the corresponding coin denomination. The insert 74 is calibrated to critically position, in the radial direction, only the correct denomination. FIG. 3 depicts that the clearance between the tip 34*a* and the insert corner is very small. Also, an abutment 38 is located to engage the dog 34 precisely at maximum deflection with the correct denomination. This limits on the other end the range of pivotal motion of the coin dog 34.

Figure 4:
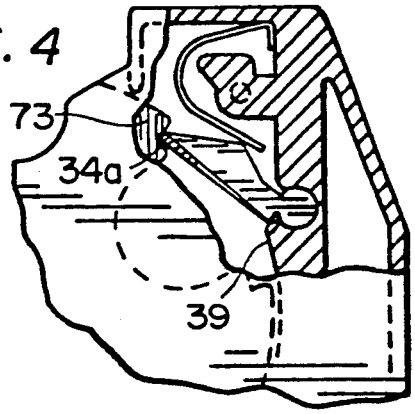
FIG. 4 is a front view of the front plate assembly, partially broken away, and illustrating the upper coin dog catching the replaceable coin insert.

If the coin is absent, the tip 34*a* catches a stop corner 73 formed in the insert 74, as represented particularly in FIG. 4, preventing further rotation of the coin wheel 52. The case is similar where a coin is loaded having a diameter smaller than that calibrated. The coin may be too large to be discriminated by dropping through the insert 74. However, the reduced diameter of the incorrect coin will not sufficiently deflect the tip 34*a*.

For coin diameters greater than that calibrated, the dog 34 prematurely engages abutment 38 also jamming the coin wheel 52. Thus, the coin dog 34 acts as a throttle disposed in the main coin channel. Accordingly, the coin dog 34, being biased against the coin wheel 52, comprises a second discrimination means of the coin carrier assembly. Also, the coin dog 34 comprises the first pawl controlling coin passage, in this instance by discrimination, through the main coin channel.

Correct insert calibration can be achieved by adjusting the radial depth of the pocket defined by the above described geometry of the insert 74. More particularly, the radial depth can be adjusted at which the banks 78*a*, 78*b* converge to cradle a valid coin. Alternatively, the adjustment may be made in the radial position on the coin wheel 52 at which the insert 74 is mounted. Thus, the critically calibrated positioning insert 74, in conjunction with the coin dog 34, acts as a discriminator of coins based on diameter.

In another feature for controlling coin passage through the mechanism 20, the race 39 closely circumscribes the coin wheel 52 as illustrated. In this case, each replaceable insert must correctly define this main coin channel such that its corresponding denomination clears the race 39.

This close proximity protects the mechanism from the introduction of debris and dirt between moving parts. Accumulation of foreign substances eventually wears parts or jams the mechanism. Another advantage of the race 39 intimately enveloping the coin wheel 52 is that it becomes difficult to introduce a tool to deflect the coin dog 34 and cheat the machine.

Turning to the back plate assembly 86, the back plate 88 is preferably formed from metal by machining or molding. The back plate 88 comprises a gib or fixture on which a variety of devices are mounted for controlling passage of a coin through the main channel of the coin receiving mechanism 20. Among these are devices which engage the coin including a washer pawl 90, comprising one discrimination mechanism, and a coin ejection pawl 100.

The washer pawl 90, in conjunction with another coin positioning attribute of the calibrated insert 74, comprises a coin discriminator based on thickness. Thus, the main coin channel is adjustable or convertibly defined in its thickness by one of several replaceable inserts cooperating with the washer pawl 90 as follows.

The pawl 90 is mounted on a fixture 92 which in turn, is mounted upon a rear surface 88*a* of the plate 88. The washer pawl 90 includes a pawl tip 90*a*. The tip 90*a* protrudes through an aperture 88*b* formed in the plate 88 and is angled toward the coin wheel 52. More particularly, the pawl tip 90*a* is located at a radial position coincident with at least a portion of the pocket defined by the insert 74.

As illustrated, the washer pawl 90 is maintained on the fixture 92 by mounting thereon a keeper tab 94 disposed on a leaf spring 96. The tab 94 and spring 96 are secured to the fixture 92 by a screw 94*a*. The washer pawl 90 is caught, by the tab 94 and spring 96, in a groove provided in fixture 92 but is not secured by the screw 94*a*. This facilitates the spring biased pawl 90 to reciprocate in an axial direction of the coin receipt mechanism 20 (perpendicular to the radial direction and parallel with the input and output shafts 56, 58). Thus, the pawl tip 90*a* is urged into contact with the coin wheel 52.

When a coin is loaded in the insert 74 and the coin wheel 52 is rotated, the coin passes under and in contact with the pawl tip 90*a*. The thickness, in the axial direction, of the central insert surface 76 is calibrated such that only a valid coin presents the pawl tip 90*a* with a surface flush with insert banks 78*a*, 78*b*. Consequently, the tip 90*a* does not deflect and the coin wheel 52 continues to rotate.

On the other hand, when an invalid coin of improper thickness is inserted, the coin will not present itself flush within the insert 74. If the coin is too thin, the tip 90*a* of the spring biased washer pawl 90 will remain in contact with the coin and thus will drop, in the axial direction, within the banks 78*a*, 78*b*. When the second bank 78*b* rotates around to the tip 90*a*, its surface will present itself as elevated relative to the coin. Hence, the washer pawl tip 90*a* will catch on the edge presented by this surface.

Correspondingly, if the invalid coin is too thick relative to the calibrated insert 74, the coin will present the pawl tip 90*a* with an edge elevated over the first bank 78*a*. Again the tip 90*a* will jam further rotation of the coin wheel 52. The replaceable insert, thus calibrated in a thickness dimension, cooperates with the washer pawl 90 to control coin passage through the main channel and correctly position only coins of the predetermined denomination in the axial direction. The washer pawl 90, engaging the coin wheel 52, thus comprises a third discriminator in contact with the coin carrier member 50. Further, the washer pawl 90 comprises a second pawl controlling coin passage through the main channel, in this instance by discrimination.

Similarly, the coin ejection pawl 100 coacts with the calibrated insert. When a legitimate coin rotates about to the ejection pawl 100, the latter engages the coin ejecting it into a coin box. The insert positions the coin in the radial or axial directions to achieve this contact with the ejection pawl 100. If the insert 74 becomes contaminated with dirt or a sticky substance and the coin is not released with the force of gravity alone, the ejection pawl 100 advantageously urges the coin ensuring release. Also, if the coin receiving mechanism 20 is not oriented with respect to gravity the coin can still be reliably ejected. Hence, the ejection pawl 100 comprises a third pawl for controlling coin passage through the main channel, in this instance, by ejecting the coin.

The above described inserts are particularly useful in multiple coin arrangements by facilitating simple customization of the multiple coin mechanism. In a multiple coin adaptation, the coin mechanism generally requires two coins in order to be rendered operable and dispense the merchandise. This allows items to be sold from a bulk vending machine even when the value of a discrete unit of the merchandise does not correspond to a single coin denomination. In other words, multiple coins are required to dispense the merchandise (e.g. $0.26, $0.30, $0.35). As above, each coin pocket is defined by an insert which correctly positions its respective coin, in both the radial and axial directions, to permit the valid coins to pass through similar discrimination devices.

Given the foregoing, variations and modifications to the invention should now be apparent to a person having ordinary skill in the art. These variations and modifications are intended to fall within the scope and spirit of the invention as defined by the following claims.

I claim:

1. A coin receipt mechanism in a coin-operated machine, comprising:

means for operating the machine, said means including a rotatable coin carrier wheel connected to the machine, said coin carrier comprising a first cooperating element of a coin drop through channel; and convertible discriminating means, connected to said coin carrier, for discriminating a coin from a first predetermined denomination of a first diameter and first thickness and for converting to discriminate from a second predetermined denomination of a second diameter and second thickness, said convertible discriminating means including a calibrated coin receiving insert, said receiving insert defining a pocket for receiving a coin of predetermined denomination and comprising a second cooperating element of a coin drop through channel, said first and second cooperating elements coacting to establish the coin drop through channel, for rejecting a coin of unauthorized denomination.

2. A coin receipt mechanism according to claim 1 wherein said convertible discriminating means comprises removable mounting means for removably mounting said calibrated insert to said coin carrier and allowing conversion of said convertible discriminating means by replacing said insert.

3. A coin receipt mechanism according to claim 2 further comprising a front plate disposed adjacent said coin carrier and wherein said removable mounting means comprise screws normally concealed between said front plate and said coin carrier when said coin carrier assumes a position for receiving a coin.

4. A coin receipt mechanism according to claim 1 wherein said insert apertured wall defines the drop-through channel with a calibrated width less than or equal to a diameter of the predetermined denomination to which said insert is calibrated.

5. A coin receipt mechanism according to claim 1 wherein said insert establishes an apertured wall cooperating to define the entry of a coin receiving channel.

6. A coin receipt mechanism according to claim 1 wherein said convertible discriminating means includes a pawl and a resilient member for urging said pawl into engagement with said coin wheel and capable of preventing rotation of said coin wheel, and wherein said insert is mounted on said coin wheel and is calibrated to receive and locate only a valid coin of one of the predetermined denominations in a predetermined position relative to said pawl to deflect said pawl allowing rotation of said coin wheel.

7. A coin receipt mechanism according to claim 6 wherein said coin wheel comprises an annular form having a circumference and a radial direction associated therewith, wherein said pawl is disposed radially about said coin wheel and is resiliently engaged with said coin wheel circumference, and wherein said insert comprises a wall extending to a predetermined radial depth and locating only a valid coin in a predetermined radial position for deflecting said pawl.

8. A coin receipt mechanism according to claim 6 wherein said coin wheel comprises an annular form having a face and an axial direction associated therewith and normal to said face, wherein said pawl is disposed over said coin wheel in the axial direction and is resiliently engaged with said face of said coin wheel, and wherein said insert comprises a wall extending to a predetermined axial depth and locating only a valid coin in a predetermined axial position for deflecting said pawl.

9. A coin receipt mechanism in a coin-operated machine, comprising:

a back plate, said back plate forming a first cooperating element of a coin channel;

a rotatable coin carrier means, operably connected to the machine, for rotatably passing a valid coin of defined depth and width in said mechanism to operate the machine and dispense merchandise contained therein, said rotatable coin carrier means rotatably abutting said back plate and forming the first cooperating member of a coin drop through channel;

pawl means for controlling passage of the coin through said coin mechanism, said pawl means being connected to said back plate to discriminate between valid and unauthorized coins; and calibrated coin receiving insert means for forming a coin receiving pocket for receiving a coin of authorized denomination, for providing a second cooperating element to establish a coin channel, and for adjustably defining said coin channel, said first and second cooperating elements coacting to establish said coin channel entry and for locating the coin in a predetermined position within said pocket relative to said pawl to cooperate therewith and permit passage of a valid coin through said mechanism and establishing the second cooperating member of a coin drop through channel to pass unauthorized coins of dimensions smaller than authorized coins through said coin drop through channel.

10. A coin receipt mechanism according to claim 9 wherein said coin carrier means comprises a coin wheel and wherein said calibrated coin receiving insert means comprises a calibrated coin insert and removable mounting means for removably mounting said calibrated insert to said coin wheel allowing replacement of said insert for adjustably defining said coin channel.

11. A coin receipt mechanism according to claim 10 further comprising a front plate disposed adjacent said coin wheel and wherein said removable mounting means comprise screws normally concealed between said front plate and said coin wheel when said coin wheel assumes a position for receiving a coin.

12. A coin receipt mechanism according to claim 10 wherein said passage control means includes discrimination means for controlling passage of the coin through the coin channel by discriminating the coin from the predetermined denomination.

13. A coin receipt mechanism according to claim 12 wherein said passage control discrimination means includes a resilient member urging said pawl into engagement with said coin wheel allowing the pawl to prevent rotation of said coin wheel, and wherein said insert is mounted on said coin wheel and is calibrated to receive and locate only a valid coin of the predetermined denomination in the predetermined position relative to said pawl to deflect said pawl allowing rotation of said coin wheel.

14. A coin receipt mechanism according to claim 13 wherein said coin wheel comprises an annular form having a circumference and a radial direction associated therewith, wherein said pawl is disposed radially about said coin wheel and said resilient member urges said pawl into engagement with said coin wheel circumference, and wherein said insert comprises a wall extending to a predetermined radial depth and locating only a valid coin in a predetermined radial position for deflecting said pawl.

15. A coin receipt mechanism according to claim 13 wherein said coin wheel comprises an annular form having a face and an axial direction associated therewith and normal to said face, wherein said pawl is disposed over said coin wheel in the axial direction and said resilient member urges said pawl into engagement with said face of said coin wheel, and wherein said insert comprises a wall extending to a predetermined axial depth and locating only a valid coin in a predetermined axial position for deflecting said pawl.

16. A coin receipt mechanism according to claim 10 wherein said passage control means includes ejection means for controlling passage of the coin through the coin channel by ejecting the coin from the coin channel.

17. A coin receipt mechanism in a coin-operated machine, comprising:

a rotatable coin wheel carrier, rotatably connected to a back plate, said rotatable coin wheel carrier defining a first element of a cooperating coin drop through channel and said back plate defining a first cooperating member of a coin entry of a coin channel;

means for controlling passage of the coin through said coin channel, said passage control means including a pawl for engaging the coin; and a calibrated coin receiving insert, forming a second cooperating element of a coin drop through channel and a second cooperating member of a coin entry of said coin channel, said first and second members cooperating to define said coin channel, said calibrated coin insert for adjustably defining said coin channel which is calibrated with said insert to a predetermined coin denomination, and for locating the coin in a predetermined position relative to said pawl to urge the coin into predetermined contact with said pawl.

18. A coin operated bulk vending machine, comprising:

a) a base;

b) a merchandise container, set on and above said base;

c) a merchandise wheel disposed between said base and said container for selecting a discrete quantity of merchandise to be dispensed upon operation of said machine;

d) a merchandise dispensing passage for communicating said discrete quantity of merchandise to an opening disposed in said base; and e) a coin receiving mechanism disposed on said base and operably connected to said merchandise wheel to rotate said wheel to dispense merchandise into said passage, said coin receiving mechanism including a back plate comprising first cooperating element of an entry to a coin receiving channel, a rotatable coin wheel carrier comprising first cooperating member of a coin drop through channel, convertible discriminating means, connected to said coin wheel carrier for discriminating a coin from a first predetermined denomination of a first diameter and first thickness and for converting to discriminate from a second predetermined denomination of a second diameter and second thickness, said convertible discriminating means including a calibrated coin receiving insert comprising a second cooperating element of an entry to a coin receiving channel, said first and second element coacting to establish said coin receiving channel for accepting a coin of one of the predetermined denominations and said convertible discriminating means defining a second cooperating member to establish a coin drop through channel, said first and second members coacting to establish said coin drop through channel for rejecting a coin of unauthorized denomination.

19. A coin receipt mechanism in a coin-operated machine for preventing introduction of a coin of an unauthorized denomination and for actuation of the machine upon introduction of a coin of an authorized denomination, comprising:

an annular coin carrier defined by a back plate and a rotatable coin wheel having a circumference and a radial direction associated therewith said rotatable coin wheel rotatably abutting said back plate, and convertible discriminating means, connected along the radius of said coin carrier and proximate to the circumference thereof for discriminating a coin from a first authorized denomination of a first diameter and first thickness and for converting to discriminate from a second authorized denomination of a second diameter and second thickness, said convertible discriminating means including a calibrated coin receiving insert for accepting a coin of one of the authorized denominations by forming a pocket therefor with said back plate and establishing a coin drop through channel with said rotatable coin wheel for coins of unauthorized denomination, and a resilient member, and a displacable pawl disposed radially about said coin wheel to permit rotation of said coin wheel when displaced by a coin of a predetermined denomination, wherein said resilient member urges said rotatable coin wheel and pawl into engagement to prevent rotation of said coin wheel unless said pawl is displaced by said coin of one of the authorized denominations and said insert comprises a wall extending to a predetermined radial depth and locating only a valid coin in a predetermined radial position for deflecting said pawl.

* * * * *